United States Patent [19]

Parks et al.

[11] 4,028,701

[45] June 7, 1977

[54] QUASI-CORNER REFLECTORS FOR ELECTROMAGNETIC RADIATION

[76] Inventors: Jill J. Parks, P.O. Box 325; Stephen R. Snook, P.O. Box 846, both of Port Hueneme, Calif. 93041

[22] Filed: Apr. 5, 1976

[21] Appl. No.: 673,568

[52] U.S. Cl. ..... 343/18 C
[51] Int. Cl.² ..... H01Q 15/20
[58] Field of Search ..... 343/18 C

[56] References Cited

UNITED STATES PATENTS 2,721,998 10/1955 Holm ..... 343/18 C

FOREIGN PATENTS OR APPLICATIONS 168,322 8/1959 Sweden ..... 343/18 C

*Primary Examiner*—Malcolm F. Hubler
*Attorney, Agent, or Firm*—Richard S. Sciascia; Joseph M. St. Amand

[57] ABSTRACT

An assembly of collapsible quasi-corner reflectors which when folded and compressed forms a small, compact and easily deployable device for reflecting electromagnetic radiation. Upon being deployed, self-contained spring action expands the assembly into a long series spiral of side-by-side open pyramidal cells each having a somewhat square aperture and four planar triangular walls whose angularity and flat interior metallic surfaces provide enhanced reflectivity.

10 Claims, 18 Drawing Figures

QUASI-CORNER REFLECTORS FOR ELECTROMAGNETIC RADIATION

BACKGROUND OF THE INVENTION

This invention relates to reflectors for electromagnetic radiation and particularly to an easily deployable spiral series of quasi-corner reflectors.

It is desirable that electromagnetic radiation reflectors for targets, chaff, distress signals, radar reflectors and radiant detectors should retransmit in all directions.

Numerous types of reflectors, particularly for radar waves, have been proposed in the past. Single surface reflectors have usually proven to be unsatisfactory since they only reflect back along a path parallel to the incident radiation path when the reflector surface is normal to the radiation beam. Generally, a corner reflector will return a stronger radar echo over a wider band than from ordinary chaff. Previous type devices which provide multi-sided angular reflectors for electromagnetic radiation have been complex and difficult to construct as well as expensive, and have not provided the needed angularity and reflectivity. In addition, these previous devices have been bulky, used springs or outside force to open them, were required to be hoisted on masts or rods, or otherwise were not easily deployable. One such device which looks somewhat similar to the present invention is found in Swedish Pat. No. 168,322 of Aug. 25, 1959. However, the Swedish invention is folded differently and tends to remain in a collapsed state, rather than open, and must be expanded by hoisting it up a mast run through the center of the device to be deployed. Further, the reflective cavities in the Swedish device have two curved surfaces only, when extended, providing less angularity and reflectivity. The present device overcomes many of the disadvantages of the prior devices.

It is an object of the present invention to provide a deployable electromagnetic radiation reflector assembly that will provide a large reflective surface area, is light in weight, and is capable of being collapsed into a compact configuration.

Another object of the invention is to provide a compact reflector assembly having self-contained, spring-like action which will self expand the assembly into a large reflective structure of quasi-corner reflectors upon being deployed.

Still another object of the invention is to provide an easily deployed spiral series assembly of quasi-corner reflectors for electromagnetic radiation.

A further object of the device is to provide a quasi-corner reflector assembly for electronic countermeasure use.

SUMMARY OF THE INVENTION

This invention provides a readily deployable assembly of quasi-corner reflectors for electromagnetic radiation. The folded walls of the reflectors provide spring action which expands the assembly upon deployment into a long spiral of side-by-side pyramidal cavities each having four planar triangular walls whose flat interior metallic surfaces and angular relationship provide greater reflectivity. The assembly is easily collapsed into a compact configuration which is readily deployable to form a reflector structure having large reflective surface area.

DETAILED DESCRIPTION OF THE PREFERRED EMBODIMENT

Figure 1:
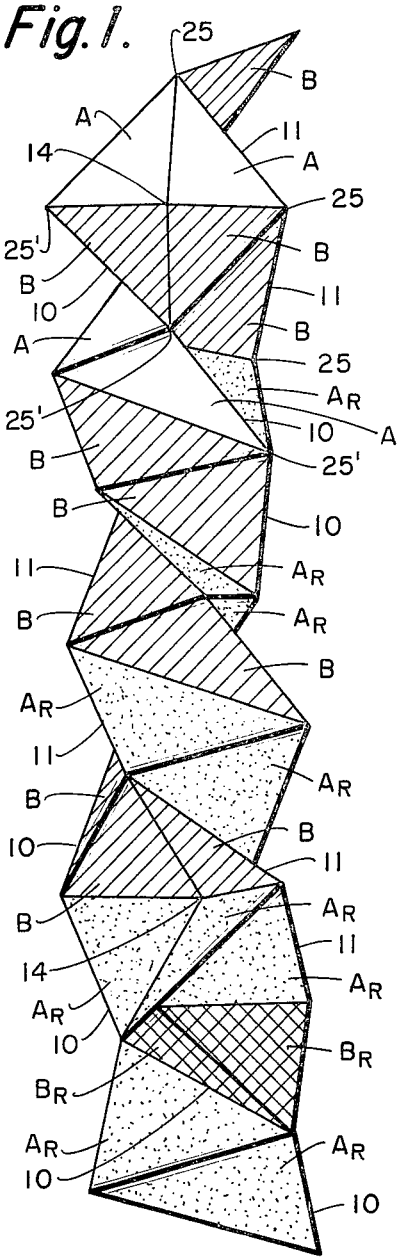
FIG. 1 shows a perspective side view of a preferred embodiment of the invention in the open deployed state.

The reflector assembly shown in FIG. 1 is in its normal expanded (i.e., deployed) state. It consists of a spiral series of side-by-side four-sided pyramidal cavities. The base of such pyramidal cavities are parallelogrammic; in its normal expanded state the optimum shape of the pyramid base or cavity opening being a square. Each pyramidal cavity, in the assembly, lies side-by-side to the next one in a spiral series, as shown in the drawing. The junction points of respective opposite opening edges, such as 10 and 11, lie in two respective common spiral paths. The vertex 14 of each cavity lies in a third common spiral path. The planar triangular interior sides are of thin metal, metal surfaced composition or other suitable material having a reflective metallic coating thereon. The exterior sides of each cavity are usually metallic also. Metallized thin sheet Mylar has proven to be suitable material for this purpose. In addition, the metallic surfaces may have luminescent coatings, selective colors or other identifying features thereon for visual as well as electronic detection. Surfaces which simultaneously provide both good reflection of radar energy, for example, and high visible light reflectivity can be used, or two or more type reflective surfaces can be used with each assembly.

Figure 2:
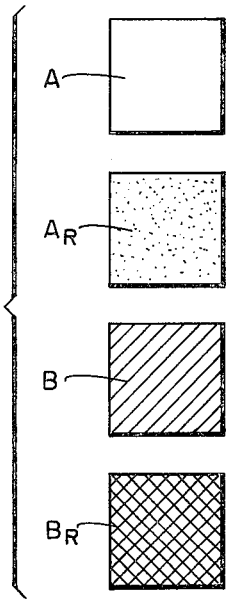
FIG. 2 shows shading used to identify various surfaces in the reflector assembly.

FIG. 2 illustrates the shadings used to identify the various surfaces of the assembly shown in FIG. 1 and in FIGS. 3 through 18. By shading various wall surfaces differently, the opposite sides of each of the components can readily be identified in the completed assembly of FIG. 1.

Figure 4:
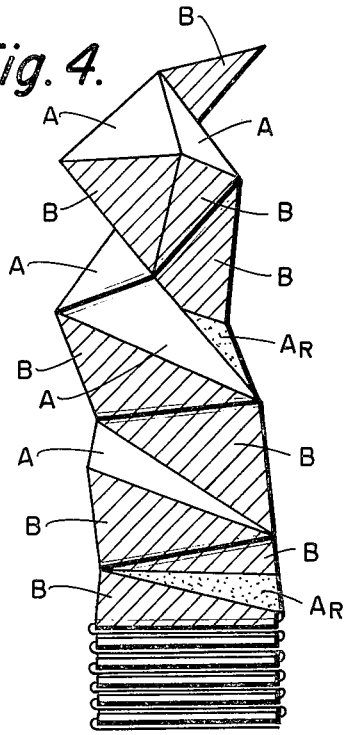
FIG. 4 shows the compact unit of FIG. 3 as it commences to expand.
Figure 3:
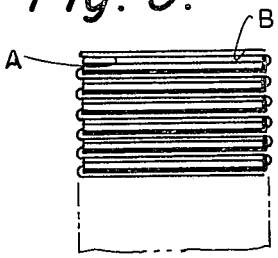
FIG. 3 is an illustration compressed into a compact unit ready for deployment.

The assembly of FIG. 1, when folded and compressed into a compact configuration, will take on the appearance of a small unit, as shown in FIG. 3. Many of these units can be packed into a small package ready for deployment as desired. The material used to form the walls of the assembly retain spring-like action along the folds, thereby causing each small unit, such as shown in FIG. 3, to expand into a spiral of pyramidal cells, when deployed, thereby presenting a large reflective area as in FIG. 1. FIG. 4 shows the assembly partially expanded following release after being compressed into a small unit as in FIG. 3.

Figure 5:
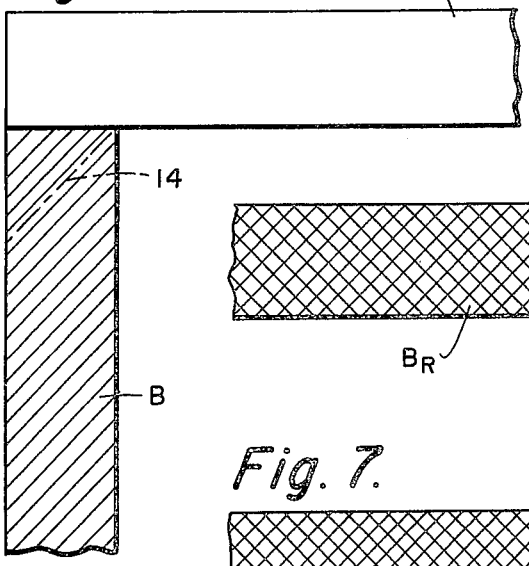
FIGS. 5–17 illustrate a series of folding steps for producing the reflector assembly as shown in FIG. 1.

One example of constructing a spiral reflector assembly as in FIG. 1 is by folding two long metallic or metallic surfaced thin strips, such as A and B in FIG. 5. A particular sequence of steps for folding strips A and B is necessary to result in a spiral assembly of side-by-side, four-sided pyramidal cavities, as will be subsequently described and shown in FIGS. 5 through 18.

The obverse or front sides of the strips are identified as A and B while the reverse sides of the strips have been identified as $A_R$ or $B_R$, respectively, and each of the strip sides are shaded, as shown in FIG. 2, merely for readily identifying that portion of a strip surface which is being viewed in the drawings and for assisting in describing the sequence of folds required to obtain the particular spiral assembly shown in the normal expanded open configuration position shown in FIG. 1. The particular shading used for the various surfaces of strips A and B is in no way intended to represent any particular material or color, but is used merely to readily identify a particular strip surface. The folding sequence is as follows:

Step 1) Starting with two long metallic strips A and B, the flat surfaces of the ends of the two strips are overlapped at right angles to each other and fastened together, as shown in FIG. 5, by any suitable means with surfaces $A_R$ and $B_R$ facing the plane of the drawing and surfaces A and B facing the viewer.

Figure 6:
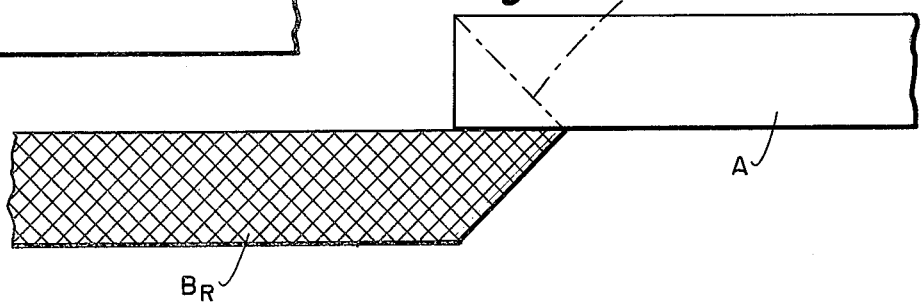

Step 2) Strip B is then folded along the 45° angle broken line 14, shown in FIG. 5, to the position shown in FIG. 6 exposing the reverse surface $B_R$.

Figure 7:
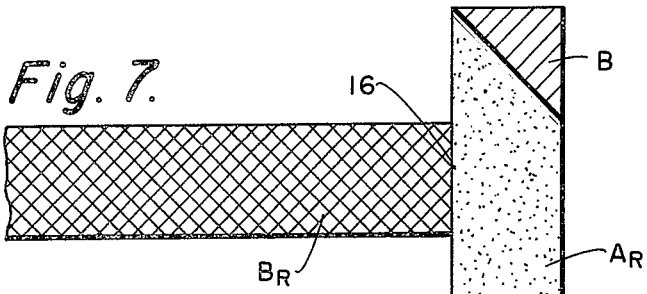

Step 3) Strip A is then folded along the 45° angle broken line 15 on surface A of FIG. 6 to the position shown in FIG. 7 exposing the reverse surface $A_R$.

Step 4) Strip B is then folded at 16 in FIG. 7 along the edge of strip A over surface $A_R$ to the position shown in FIG. 8 again exposing the obverse side of strip B.

Figure 8:
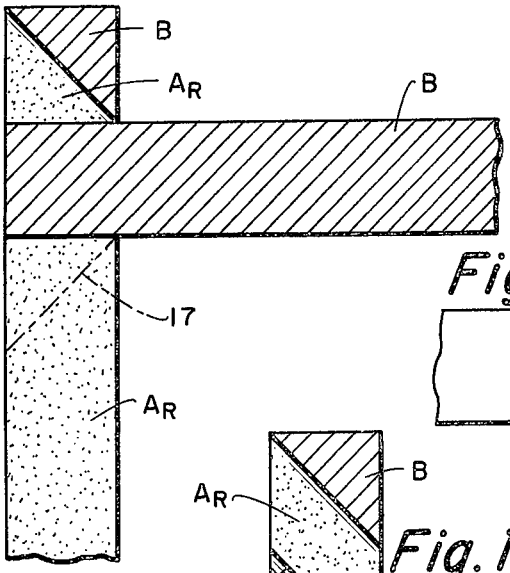

Step 5) Fold strip A along the 45° broken line 17 shown in FIG. 8 to the position shown in FIG. 9 again exposing the obverse side of strip A.

Figure 9:
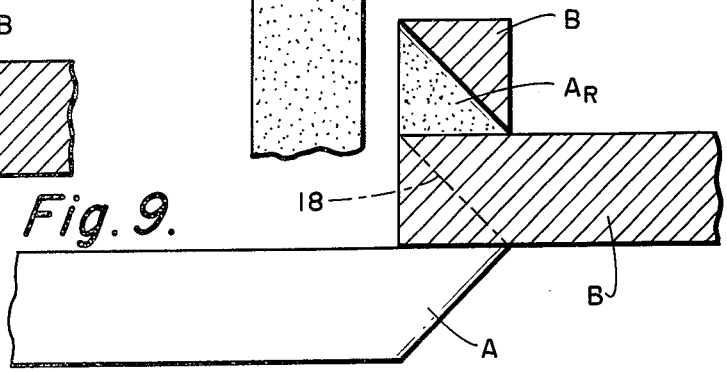
Figure 10:
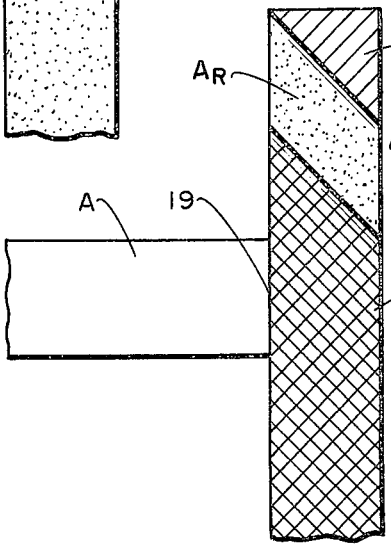

Step 6) Fold strip B along the 45° angle broken line 18 on surface B of FIG. 9 to the position shown in FIG. 10, thereby exposing the reverse side $B_R$ again.

Figure 11:
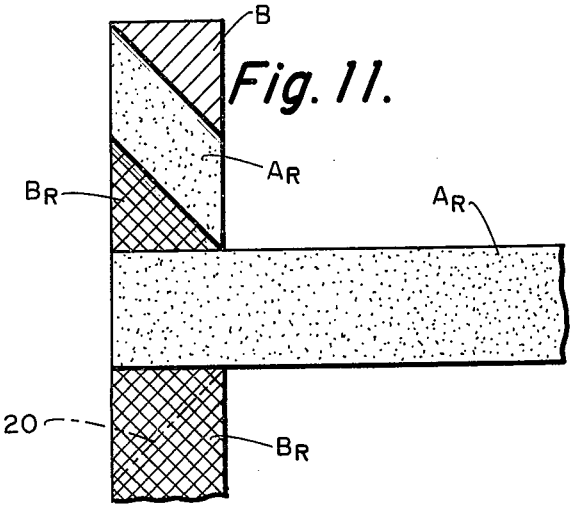

Step 7) Fold strip A at 19 in FIG. 10 along the edge of strip B over surface $B_R$ to the position shown in FIG. 11.

Figure 12:
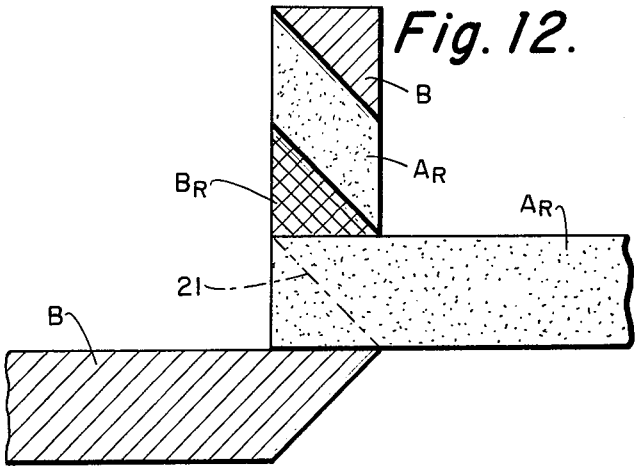

Step 8) Fold strip B along the 45° broken line 20 on surface $B_R$ of FIG. 11 to the position shown in FIG. 12.

Figure 13:
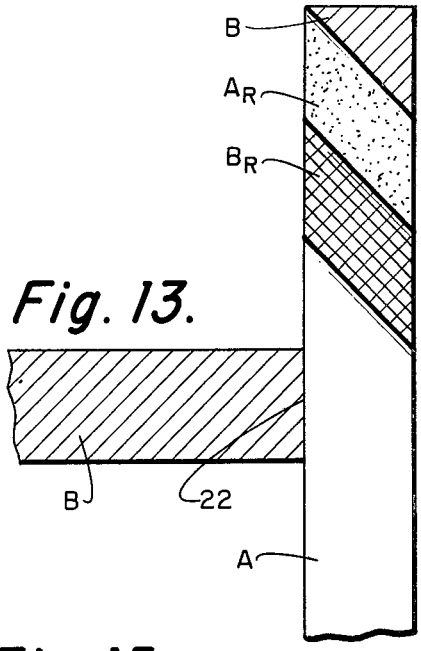

Step 9) Fold strip A along the 45° broken line 21 on surface $A_R$ of FIG. 12 to the position shown in FIG. 13.

Figure 14:
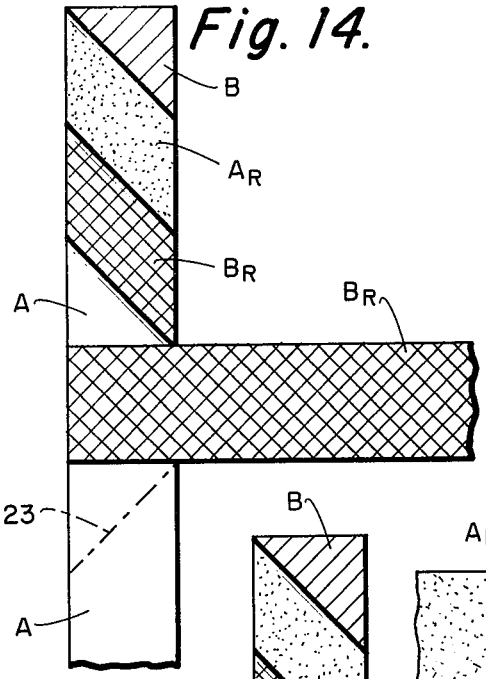

Step 10) Fold strip B at 22 along the edge of strip A and over surface A in FIG. 13 to the position shown in FIG. 14.

Figure 15:
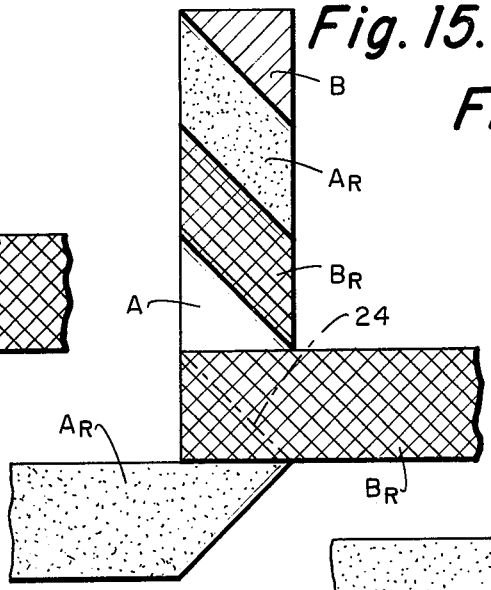

Step 11) Fold strip A along the 45° broken line 23 on surface A FIG. 14 to the position shown in FIG. 15.

Figure 16:
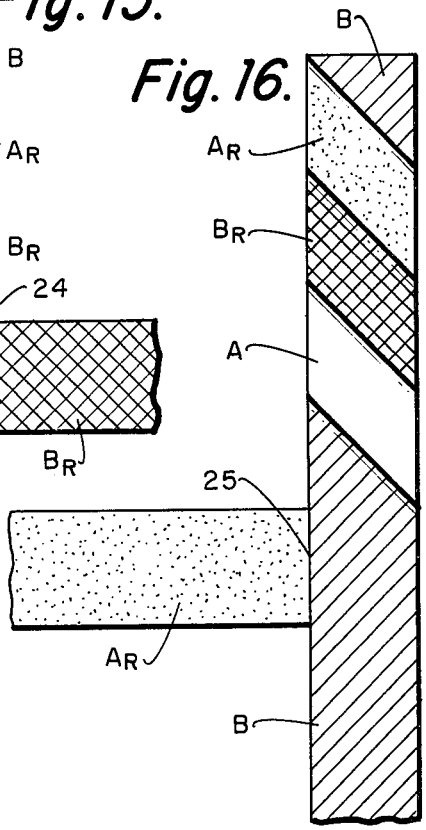

Step 12) Fold strip B along the 45° broken line 24 on surface $B_R$ of FIG. 15 to the position shown in FIG. 16.

Figure 17:
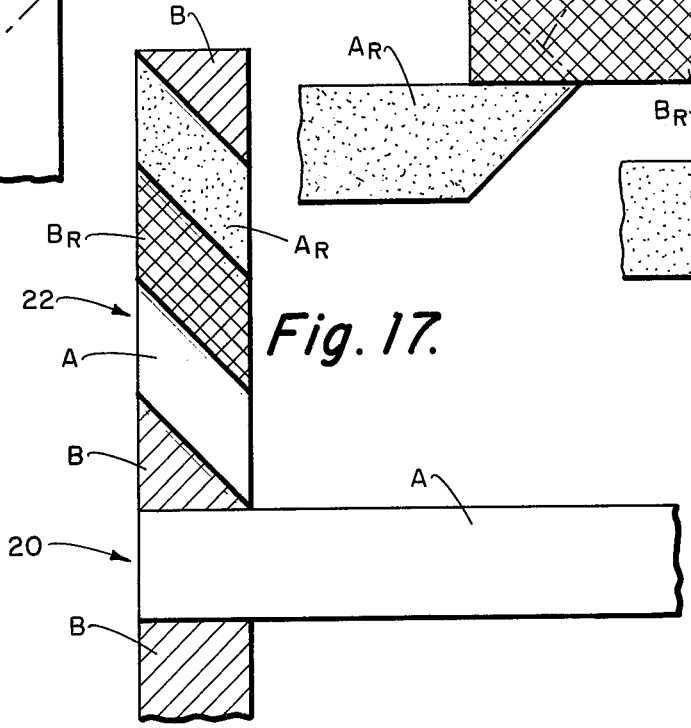

Step 13) Fold strip A at 25, FIG. 16, along the edge of strip B and over surface B to the position shown in FIG. 17. This places the unfolded portions of strips A and B in the lower portion 20 of FIG. 17 in the same relationship, at right angles to each other, as the initial strips shown in FIG. 5. Then by repeating the series of steps 2 through 13 the assembly can be made any length desired.

The above sequence of steps produces a long flat assembly, as shown in the upper portion 22 of FIG. 17, for example, the length of which is determined by the number of times the sequence of steps is repeated. A long flat assembly, such as in the upper portion 22 of FIG. 17, is shown in FIG. 18.

Figure 18:
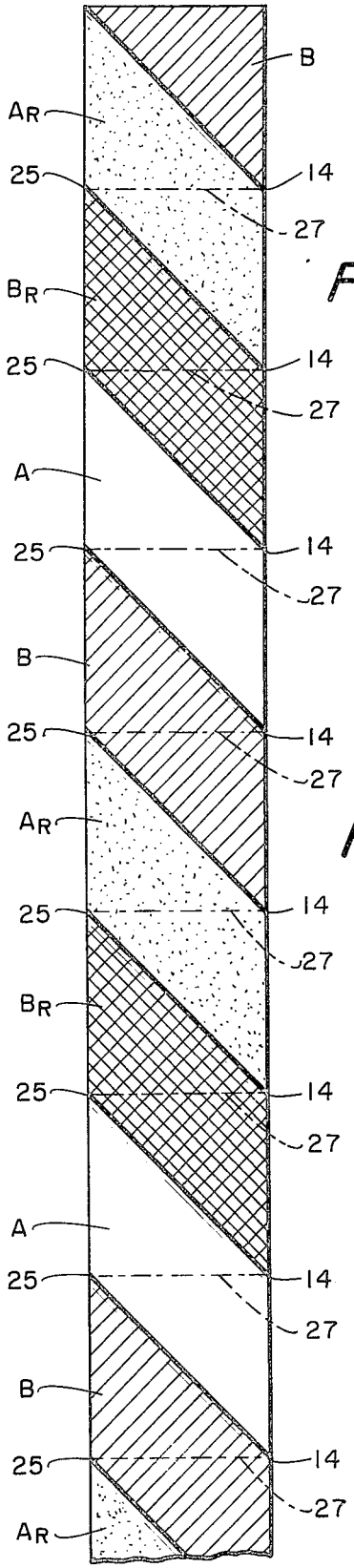
FIG. 18 shows a long flat folded reflector assembly prior to opening and compressing into the compact unit of FIG. 3.

By opening the flat folded assembly shown in FIG. 18 at points 25, a series of cavities will be formed, each having a vertex at points 14, respectively. By compressing the ends of the assembly together in a longitudinal direction, as points 25 and 25′, FIG. 1, are separated, fold creases will be formed along broken lines 27, shown in FIG. 18, as the full assembly is compressed into a compact unit as shown in FIG. 3. Upon release, or removal of force retaining the assembly in a compact unit as in FIG. 3, the assembly will commence to expand as shown in FIG. 4, by way of example, until fully expanded into its deployed spiral arrangement as shown in FIG. 1.

Variations can be made in the arrangement of pyramidal cavities by interrupting the spiral series every so often. For example, after each series of folding steps 2 through 13, a series of right angle folds only can be introduced, if desired, before resuming another series of folding steps 2 through 13.

When deployed in the air, the open spiral assembly will rotate as it falls due to its helical form. This causes radiation from a source to be reflected by different reflective cavities as the expanded assembly rotates.

By using radiation absorbent or transmissive surfaces in some of the cavities, interruption of return radiation from the reflective assembly can be caused to occur, tending to modulate return radiation.

Obviously many modifications and variations of the present invention are possible in light of the above teachings. It is therefore to be understood that within the scope of the appended claims the invention may be practiced otherwise than as specifically described.

What is claimed is:

1. A plural polyhedrical reflective device for electromagnetic radiation, comprising:
   a. a plurality of four-sided pyramidal cavities having reflective surfaces;
   b. the base of each of said four sides being equal in length; the intersection of a plane normal to the vertical axis with the four sides of any one of said pyramidal cavities forming an equal sided parallelogram;
   c. the vertex of each pyramidal cavity lying in a first common spiral path;
   d. respective base corners of each pyramidal cavity lying in one of respective second and third common spiral paths;
   e. said first, second and third spiral paths being symmetrical to each other about a common axis;
   f. said plurality of pyramidal cavities being positioned adjacent each other in a side-by-side relationship forming a long spiral assembly of pyramidal electromagnetic energy reflectors.

2. A reflective device as in claim 1 wherein said long spiral assembly of pyramidal cavity reflectors is folded along the side edges of the pyramidal cavities and compressed longitudinally along said common spiral axis to form a compact square based unit available for ready deployment.

3. A reflective device as in claim 1 wherein said long spiral assembly of pyramidal cavities is extended and flattened to form an elongated flat unit.

4. A reflective device as in claim 2 wherein said compressed compact unit retains spring force at folds along the side edges of said pyramidal cavities which forces said assembly to its open and deployed spiral position upon removal of compression forces.

5. A reflective device as in claim 1 wherein the interior and exterior surface of said pyramidal cavities are of different reflective materials.

6. A reflective device as in claim 1 wherein said reflective surfaces are metallic.

7. A reflective device as in claim 1 wherein said reflective surfaces are metallic and of various colors.

8. A reflective device as in claim 1 wherein the material of said reflectors is metalized plastic.

9. A reflective device as in claim 1 wherein the material of said reflectors is metal foil surface composition.

10. The method for making the plural polyhedrical reflective assembly of claim 1 from first and second long flat rectangular strips of electromagnetic radiation reflective material by a sequence of folding steps in order, as follows:

a. positioning said first strip horizontally on a planar surface with respect to said second strip which is positioned at the left end of said first strip depending vertically downward such that the strips lie at right angles to each other on said planar surface with one flat end of said first strip overlapping one flat end of said second strip;

b. folding said second strip at a 45° angle at a point immediately below the lower edge of said first strip to a horizontal position extending to the left on said planar surface;

c. folding said first strip at a 45° angle downward over the 45° fold of said second strip;

d. folding said second strip from the horizontal position extending to the left over said first strip to a horizontal position extending to the right on said planar surface;

e. folding said first strip at a 45° angle at a point immediately below the lower edge of said second strip to a horizontal position extending to the left on said planar surface;

f. folding said second strip at a 45° angle downward over the 45° fold of said first strip;

g. folding said first strip from the horizontal position extending to the left over said second strip to a horizontal position extending to the right on said planar surface;

h. folding said downward extending second strip at a 45° angle at a point immediately below the lower edge of said second strip to a horizontal position extending to the left on said planar surface;

i. folding said first strip at a 45° angle downward over the last 45° fold of said second strip;

j. folding said second strip from the last horizontal position extending to the left over said first strip to a horizontal position extending to the right on said planar surface;

k. folding said first strip at a 45° angle at a point immediately below the lower edge of said second strip to a horizontal position extending to the left on said planar surface;

l. folding said second strip at a 45° angle downward over the last 45° fold of said first strip;

m. folding said first strip from the last horizontal position extending to the left over said downward extending second strip to a horizontal position extending to the right on said planar surface, thus placing any remaining unfolded portions of said first and second strips in the original relationship as in (*a*) above;

n. repeating the sequence of steps (*a*) through (*m*) until any remaining portions of said first and second strips are folded;

o. opening the pockets formed along the right edge of the folded assembly and compressing the assembly longitudinally along the length thereof into a small, square-based compact unit adding additional fold creases at 90° to the lengthwise edges of said first and second strips as the assembly is compressed;

p. removing compression forces from the ends of the compressed assembly and allowing the assembly to partially expand, thus forming a long spiral series of adjacent four-sided pyramidal cavities.

* * * * *